United States Patent [19]

Grumbine

[11] Patent Number: 5,054,148

[45] Date of Patent: Oct. 8, 1991

[54] ORTHOTIC WITH TEXTURED SURFACE AND METHOD FOR PRODUCING SAME

[75] Inventor: Michael T. Grumbine, Whittier, Calif.

[73] Assignee: Paragon Podiatry Laboratories, Whittier, Calif.

[21] Appl. No.: 327,018

[22] Filed: Mar. 22, 1989

[51] Int. Cl.[5] ..... A43D 7/14; A61F 5/14

[52] U.S. Cl. ..... 12/142 N; 12/146 M; 36/93; 128/581

[58] Field of Search ..... 12/146 B, 1 R, 142 N, 12/146 M; 36/93; 128/595, 581

[56] References Cited

U.S. PATENT DOCUMENTS

| | | | |
|---|---|---|---|
| 1,522,890 | 1/1925 | Krap | 128/581 |
| 4,454,618 | 6/1984 | Curchod | 12/1 R |
| 4,510,636 | 4/1985 | Phillips | 12/1 R |
| 4,517,981 | 5/1985 | Santopietro et al. | 128/581 |
| 4,756,096 | 7/1988 | Meyer | 12/142 N X |
| 4,896,441 | 1/1990 | Galasso | 128/581 X |

*Primary Examiner*—Paul T. Sewell
*Assistant Examiner*—Ted Kavanaugh
*Attorney, Agent, or Firm*—Fulwider, Patton, Lee & Utecht

[57] ABSTRACT

An orthotic, for providing proper support for a patient's foot within a shoe has provided on its top and bottom surfaces closely spaced substantially parallel grooves. The grooves on the top surface control slippage of the foot across the orthotic while the grooves on the bottom surface of the orthotic control slippage of the orthotic relative to the shoe's insole. The orthotic is shaped from a single monolithic workpiece by guiding a computer-controlled milling tool along substantially closely spaced parallel passes in a preselected pattern across the workpiece to thereby produce the orthotic's surface contours and surface texture in a single operation.

5 Claims, 1 Drawing Sheet

FIG. 1
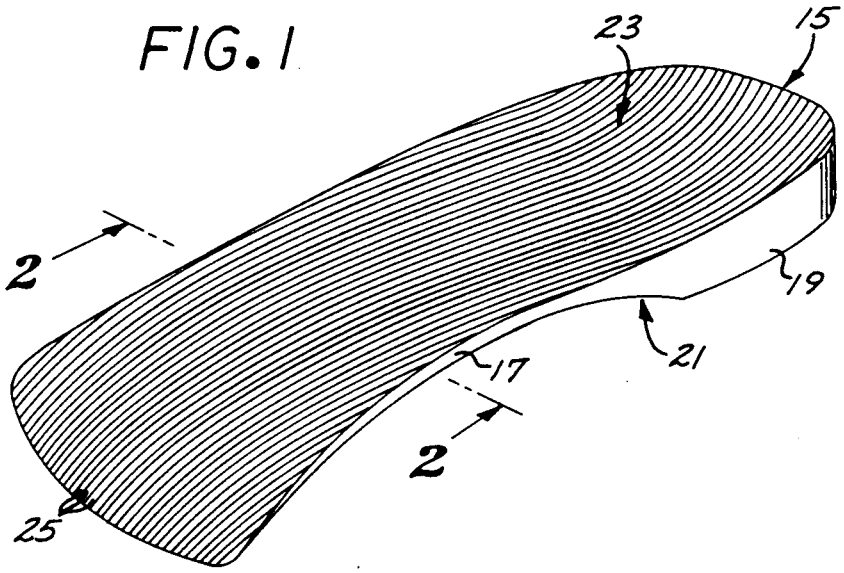
FIG. 2
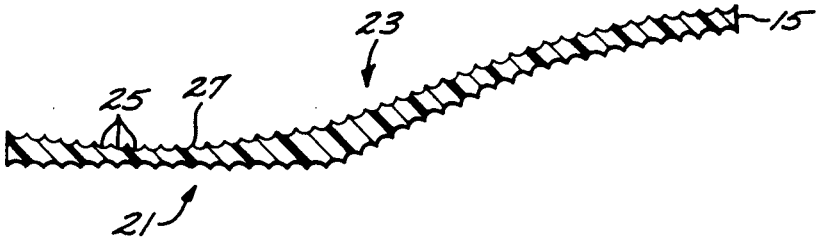
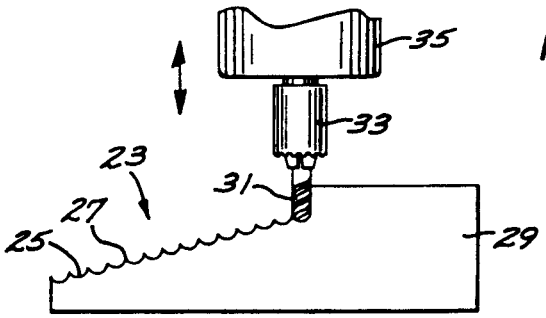
FIG. 3

ORTHOTIC WITH TEXTURED SURFACE AND METHOD FOR PRODUCING SAME

BACKGROUND OF THE INVENTION

1. Field of the Invention

The present invention relates to orthotics used for providing support for a foot within a shoe and more particularly pertains to orthotics having non-slip surfaces and methods for producing same.

2. Description of the Prior Art

Orthotics are generally fitted to realign the patient's foot within a shoe. The effectiveness of a particular orthotic depends on the amount of control afforded to the supported foot. Such control is a function of the orthotic's effectiveness in holding or supporting the foot and all of its component parts, often at specific angles under various phases of the gait cycle. The object of the foot control is to restrict the foot's deviation from the desired angles and positions and the more effectively such movements are restricted the greater the therapeutic effect; or, alternatively, to support the arch in what may be deemed as a more comfortable position. The use of orthotics can induce a patient to assume better posture and/or alleviate pain in various parts of the body. The control afforded by an orthotic is enhanced by limiting slippage, especially lateral slippage, both of the foot relative to the orthotic and the orthotic relative to the insole of the shoe. This concern has been addressed in the prior art by the affixation of textured material to the top and bottom surfaces of an orthotic. Typically the materials employed for this purpose have a random pattern of texture and are typically glued to the orthotic's surfaces.

A number of disadvantages are associated with the prior art orthotic devices that attempt to control movement of the foot or the orthotic within the shoe. The amount of control afforded by such devices is of limited effectiveness, the manufacture of such devices is expensive due to the multi-step assembly process involved, and the potential for delamination further detracts from its practicality. In addition, it is most desirable to minimize the bulk associated with an orthotic. The addition of friction surface materials to the top and bottom of an orthotic adds additional bulk and often requires the use of over-sized shoes, which is undesirable from an aesthetic and economic point-of-view. Additionally, the friction surfaces of prior art materials would substantially degrade in their effectiveness over time, seldom lasting as long in their usefulness as the orthotic itself.

The manufacture of prior art orthotics has typically involved the molding and trimming of a relatively rigid plastic such as an acrylic, polyethylene or polypropylene, to yield the desired surface contours. If a non-slip surface is desired, additional material such as, for example, a fabric is adhered to one or both surfaces. This labor intensive process results in a relatively expensive product.

SUMMARY OF THE INVENTION

The general purpose of this invention is to provide an orthotic having a textured surface resistant to wear and deterioration that controls lateral slippage of both the foot relative to the orthotic and the orthotic relative to the shoe. In addition, it is the purpose of the present invention to provide a method with which such an orthotic can be relatively inexpensively manufactured. To attain this, the present invention provides an orthotic that has a plurality of substantially parallel grooves disposed directly in the orthotic's contoured surfaces. The grooves may, for example, be arranged along the longitudinal axis of the orthotic or, alternatively, follow the contours of the orthotic surface similar in appearance to a topographical map. The orthotic device is machined from a single monolithic workpiece and thereby inherently provides a relatively strong and wear resistant structure and reduces manufacturing costs by alleviating the need for any "assembly". A ball-shaped end milling tool is employed to cut substantially parallel swaths through a block of polyproplyene in the desired pattern. The height of the milling tool within the workpiece is continuously varied to yield a desired surface contour and the successive swaths are spaced such that discernable grooves are formed on the contoured surfaces of the orthotic.

A grooved top surface checks lateral slippage of the foot relative to the orthotic while a grooved bottom surface controls slippage of the orthotic relative to the shoe's insole. Because the grooves are formed directly in the orthotic no "delamination" can occur between the orthotic and its textured surface as was possible in prior devices wherein the textured surfaces were added on. Moreover, the textured material of the orthotic shell is significantly more durable and resistant to wear.

An especially efficient method of manufacturing such an orthotic device having the grooved surface texture employs a computer controlled end mill. Data geometrically describing both the top and bottom desired surface contours are generated and formatted so that the height of a machine tool can be automatically adjusted to a preselected position for any given lateral and longitudinal position along the surface of a workpiece. The machine tool is subsequently guided along substantially parallel paths through the work piece. By guiding and controlling a machine tool in this manner, both the desired surface contour as well as the grooved surface texture are achieved in a single operation thereby providing a highly efficient manufacturing process.

Other features and advantages of the present invention will become apparent from the following detailed description, taken in conjunction with the accompanying drawings, which illustrate by way of example, the principles of the invention.

DESCRIPTION OF THE DRAWINGS

FIG. 1 is a perspective view of an embodiment of the present invention;

FIG. 2 is an enlarged cross-section of a portion of the orthotic illustrated in FIG. 1 taken along lines 2—2; and FIG. 3 illustrates an orthotic being machined according to the methods of the present invention.

DETAILED DESCRIPTION OF THE EMBODIMENT

FIG. 1 provides an illustration of an orthotic device according to the present invention. Such a device is used to properly support a patient's foot within a shoe by controlling the foot's position and angle to improve posture and/or reduce pain.

The orthotic 15 as illustrated in FIG. 1 has a heel portion 19 and a raised arch portion 17. The orthotic's top surface 23 is contoured for contact with a particular patient's foot while certain areas of the bottom surface 21 of the orthotic 15 is for contacting a shoe's insole. The entire surface of the orthotic has a plurality of closely spaced substantially parallel grooves 25 oriented, in this particular embodiment, along the orthotic's longitudinal axis.

FIG. 2 illustrates a cross-section of an orthotic taken along the lines 2—2 of FIG. 1. The parallel grooves are located both on the top surface 23 and bottom surface 21 of the orthotic. The parallel grooves 25 are spaced such that a ridge 27 remains between each adjacent groove 25. The preferred material used for the forming of such orthotics is polyolefin plastics. These materials provide sufficient overall rigidity to support the intended loads, are relatively inexpensive, are easily machined and are not subject to fracture. It has been found that grooves approximately one-tenth a millimeter in depth, 2 millimeters in width and spaced at approximated 12 grooves per inch provides the preferred effect.

In operation, the orthotic is placed within a patient's shoe to provide what has previously been determined to be the proper support for the particular patient's needs. Grooves assure that slippage between both the foot and the orthotic and the orthotic and the insole of the shoe is controlled, thereby providing a more stable platform. Various patterns or arrangements of grooves fulfill the objectives of the present invention. The grooves can be arranged longitudinally along the orthotic as illustrated in FIG. 1, or can, for example, follow the contours of the orthotic's surfaces in a fashion similar to that of a topographical map (not shown). Lateral or diagonal grooves may similarly achieve the present invention's objective of controlling slippage.

The preferred method of manufacture for the abovedescribed orthotic employs the use of a computer controlled mill. The specific contour of the top and bottom surface of an orthotic for a particular patient is first described and stored in terms of x, y, z coordinates and subsequently formatted such that a particular x, y coordinate, i.e. a specific longitudinal and lateral position on a workpiece yields a particular height (z) positioning of the machine tool. The machine tool is then guided along parallel paths through the workpiece while the machine tool's height is automatically adjusted to conform with the desired surface contour. FIG. 3 illustrates a end mill 35 whose height is controlled in conformance with the stored data. A ball-shaped milling tool 31 generally ¼" to 1½", preferably ¾", in diameter is held by a chuck 33. The high speed of rotation of the milling tool easily cuts through the workpiece 29 to yield the desired contours. The result grooves 25 are spaced to yield ridges 27 that serve to provide the desired resistance to slippage there across.

While a particular form of the invention has been illustrated and described, it will also be apparent to those it is not intended that the invention be limited except as by the appended claims.

What is claimed is:

1. A method for producing from a workpiece a non-compressive, weight bearing orthotic device for providing proper support for a patient's foot within a shoe, such orthotic device having a top surface for contacting the foot and a bottom surface for contacting a shoe's insole, comprising the steps of:

generating data geometrically descriptive of such orthotic device's desired top surface contour and bottom surface contour;

storing said data in a form suitable to provide a height position to a machine tool for any longitudinal and lateral position on such workpiece's top and bottom surfaces;

selecting a workpiece of machinable material capable of functionally or biomechanically supporting a patient's foot; and guiding a machine tool, subject to automatic height adjustments commensurate with said stored data, along successive passes across such workpiece so that an orthotic device having the desired top and bottom surface contours results, and spacing such passes so that closely spaced, substantially parallel grooves are formed in the top and bottom contoured surfaces.

2. The method of claim 1 wherein:

said machine tool is guided along successive passes along such orthotic's longitudinal axis.

3. The method of claim 1 wherein:

said machine tool is guided to follow such orthotic's surface contours in a topographical fashion.

4. The method of claim 1 wherein:

said machine tool comprises a ball-shaped milling tool having a preselected diameter.

5. The method of claim 4 wherein:

said diameter is selected and successive passes are spaced so that grooves approximately 2 mm wide, 0.10 mm deep, and spaced at approximately 12 grooves per inch result.

* * * * *